United States Patent [19]

Gayman

[11] 4,231,599

[45] Nov. 4, 1980

[54] CLOSURE LOCK-PROP

[76] Inventor: Charles Gayman, Smithshire, Ill. 61478

[21] Appl. No.: 972,062

[22] Filed: Dec. 21, 1978

[51] Int. Cl.[2] ..... E05C 17/32

[52] U.S. Cl. ..... 292/339; 292/259 R

[58] Field of Search ..... 292/338, 339, 259, 263, 292/264, 244

[56] References Cited

U.S. PATENT DOCUMENTS

| | | | |
|---|---|---|---|
| 790,653 | 5/1905 | Notthoff | 292/339 X |
| 1,151,122 | 8/1915 | Parsons | 292/338 X |
| 1,944,783 | 1/1934 | Ciriacy et al. | 292/338 |
| 2,996,731 | 8/1961 | Leptrone | 292/339 X |
| 3,280,606 | 10/1966 | Howard et al. | 292/259 |
| 4,157,128 | 6/1979 | Peters | 292/339 |

*Primary Examiner*—Richard E. Moore

*Attorney, Agent, or Firm*—Cushman, Darby & Cushman

[57] ABSTRACT

Apparatus for preventing the opening of a movable closure—such as a pivoted door—from either side thereof. First and second rods are pivotedly mounted together to be folded up for storage or transport, or to be disposed in end-to-end relationship when the apparatus is operative. A third rod slides with respect to the first and second rods and operatively engages the first and second rods to lock them together in end-to-end relationship. A fork for engaging the door knob is provided at one end of the rods, and an engaging member for securely engaging either a carpet or a smooth floor is provided at the other end of the rods. A chain having an enlarged loop at one end and an elongated pin at the other end cooperates with a tubular member formed on the rods to facilitate locking of a pivoted door from the jamb side thereof.

13 Claims, 3 Drawing Figures

CLOSURE LOCK-PROP

BACKGROUND AND SUMMARY OF THE INVENTION

The invention relates to apparatus for preventing the opening of movable closures, particularly doors pivoted for opening in one direction and embodying a jamb member for stopping movement in the other direction. There have been numerous proposals in the past for various apparatus for facilitating closure opening-preventing, however such prior proposals have usually suffered from one or more disadvantages that made the commercialization thereof unsuccessful. Some of such prior devices have been utilizable with smooth-surfaced floors, but not carpeted floors, or vice versa, and if used with both types of floors have resulted in marring or destruction of the surfaces with which they were utilized. Some of such prior devices have been too bulky and rigid and could not be easily moved into a configuration for ready storage or transport, or if movable to a position for ready storage or transport could not be securely maintained in an operative position, or could not be readily moved to an operative position. Additionally, such prior devices have been utilizable only to prevent closure opening on the opening side of the closure, and were not effective to prevent opening from the jamb side of the closure.

According to the present invention apparatus is provided for preventing an opening of a movable closure that overcomes many of the disadvantages inherent in prior art devices. The apparatus according to the present invention is utilizable with a wide variety of different door types, and is utilizable to prevent closure opening from both the opening and jamb side of the closure. The apparatus is effective for use both with carpeted and smooth-surfaced floors without defacement or destruction of the floor surfaces, does not marr or damage the closure itself, may be moved to a configuration for ready transportation or storage yet is readily assembable to a strong operative configuration, and allows for ready adjustment of the effective length thereof to adapt to different types of closures.

According to one aspect of the present invention, apparatus is provided for preventing the opening of a movable closure which includes first and second elongated rods; means for pivotally mounting the first and second rods for movement from a first position wherein the rods are bought in substantially end-to-end relationship to a second position wherein the rods extend substantially parallel to each other; means for effecting adjustment of the effective length of at least one of the rods; means associated with the first rod for firmly abutting the movable closure; means associated with the second rod for engaging a stationary member adjacent the closure to prevent relative movement between the closure and the stationary member; means for selectively locking the first and second rods in the first position thereof, and wherein the selective locking means comprises a third elongated rod having a latching portion formed on one end thereof, means formed on one of the first and second rods for allowing guided linear movement of the third rod parallel to said one of the first and second rods, and latching means formed on the other of the first and second rods for cooperating with the latching portion of the third rod to maintain the third rod latched in a position wherein it extends across the first and second rods in operative engagement with each. The third rod latching portion preferably comprises a hook and the latching means preferably comprises an aperture for receipt of the hook, a sleeve providing guided linear movement of the third rod and a finger-grasping portion formed on the third rod to facilitate relative linear or rotational movement thereof. A fork having an exterior surface of abrasion and slippage preventing material preferably abutts the closure, being particularly adapted to engage a door knob.

According to a second aspect of the present invention, apparatus for preventing an opening of the movable closure is provided comprising an elongated substantially rigid member having a first end thereof for abutting the closure and means formed on the second end thereof for engaging a stationary member adjacent the closure. The means for engaging the stationary member comprises an engaging member having first and second substantially parallel faces, the faces having different textures each capable of engaging the stationary member without defacement or destruction of the stationary member (e.g. one face for engaging a carpet and the other face for engaging a smooth surfaced floor), and means for mounting the engaging member with respect to the elongated member so that the engaging member may pivot from a position wherein the first face engages the stationary member to a position wherein the second face engages the stationary member.

According to another aspect of the present invention, apparatus for providing opening of a pivoted closure, pivoted for opening in one direction and abutting the jamb member for stopping movement in the other direction, is provided. The apparatus comprises an elongated substantially rigid member (preferably including first and second pivoted rods), and means for operatively holding the member between the pivoted closure and the stationary member adjacent either the jamb side or the opening side of the pivoted closure so that the pivoted closure may not move with respect to the stationary member whether the elongated member is disposed on the jamb side or the opening side of the pivoted closure. The operative holding means includes a chain having an enlarged link formed at one end thereof and an elongated pin at the other end thereof; a tubular member formed on the elongated member and having a slot formed therein for receipt of a link of the chain and having a passageway therethrough large enough to allow the passage of the elongated pin therethrough; a third rod slidable with respect to a sleeve formed on the second rod; and a member formed on the third rod adjacent one end thereof for engaging the first rod to tighten the chain when looped around a doorknob and with a link thereof disposed in the tubular member slot and the elongated pin holding it in that position, and hold the elongated member in locking position on the jamb side of the pivoted closure.

It is the primary object of the present invention to provide a simple, versatile, and effective apparatus for preventing the opening of a movable closure; especially from either side thereof. This and other objects of the invention will become clear from an inspection of the detailed description of the invention, and from the appended claims.

DETAILED DESCRIPTION OF THE DRAWINGS

Figure 1:
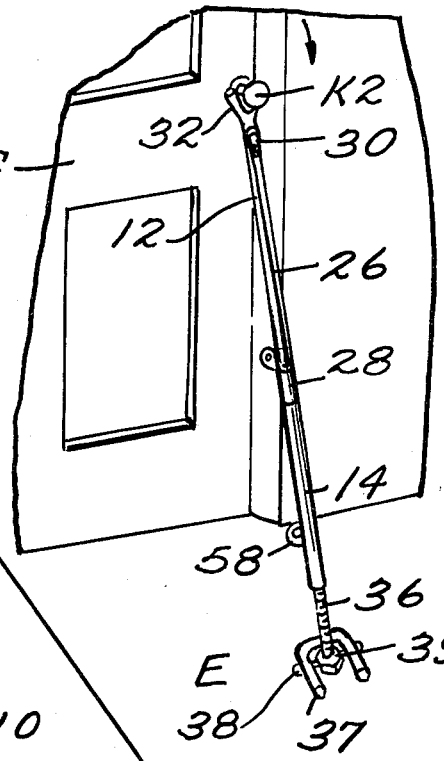
FIG. 1 is a perspective view of exemplary apparatus according to the present invention in use preventing the opening of a closure on the opening side thereof.

The basic component of the apparatus according to the present invention comprises the elongated member 10, which is preferably formed of first and second elongated rods 12,14 respectively, which elongated rods preferably are metal (e.g. steel) tubes. Means 16 are provided for pivotally mounting the rods 12,14 for movement from a first, operative, position wherein the rods abutt in substantially end-to-end relationship (see FIGS. 1 & 3) to a second position wherein the rods extend substantially parallel to each other (see FIG. 2). Means 18 are provided for effecting adjustment of the effective length of at least one of the rods, means 20 are associated with the first rod 12 for firmly abutting a movable closure C, means 22 are associated with the second rod 14 for engaging a stationary member such as floor F (see FIG. 1) adjacent the closure closure C to prevent relative movement between the closure C and the stationary member F, and mean 24 for selectively locking the first and second rods 12, 14 in the first, operative, position thereof.

The selective locking means 24 comprise a third elongated rod 26 having a latching portion, such as hook 27, formed on one end thereof, means formed on one of the first and second rods for allowing guided linear movement of the rod 26 parallel to said one of the first and second rods—such as the sleeve 28 connected to the second rod 14—and, latching means formed on the other of the first and second rods for cooperating with the latching portion 27 of the third rod 26 to maintain the third rod 26 latched in a position wherein it extends across the first and second rods in operative engagement with each (see FIG. 1), such latching means preferably comprising means defining an aperture 29 in the first rod 12, the aperture 29 for receipt of the hook 27 therein. A grasping member 30 is formed on the rod 26 adjacent the hook 27 for facilitating relative movement -both linear and rotational-of the rod 26 with respect to the rods 12, 14. The sleeve 28 is preferably provided on second rod 14 and aperture 29 on the first rod 12 in order to allow movement of the third rod 26 into operative working position by a user without the user having to kneel or stoop over a great deal.

Figure 2:
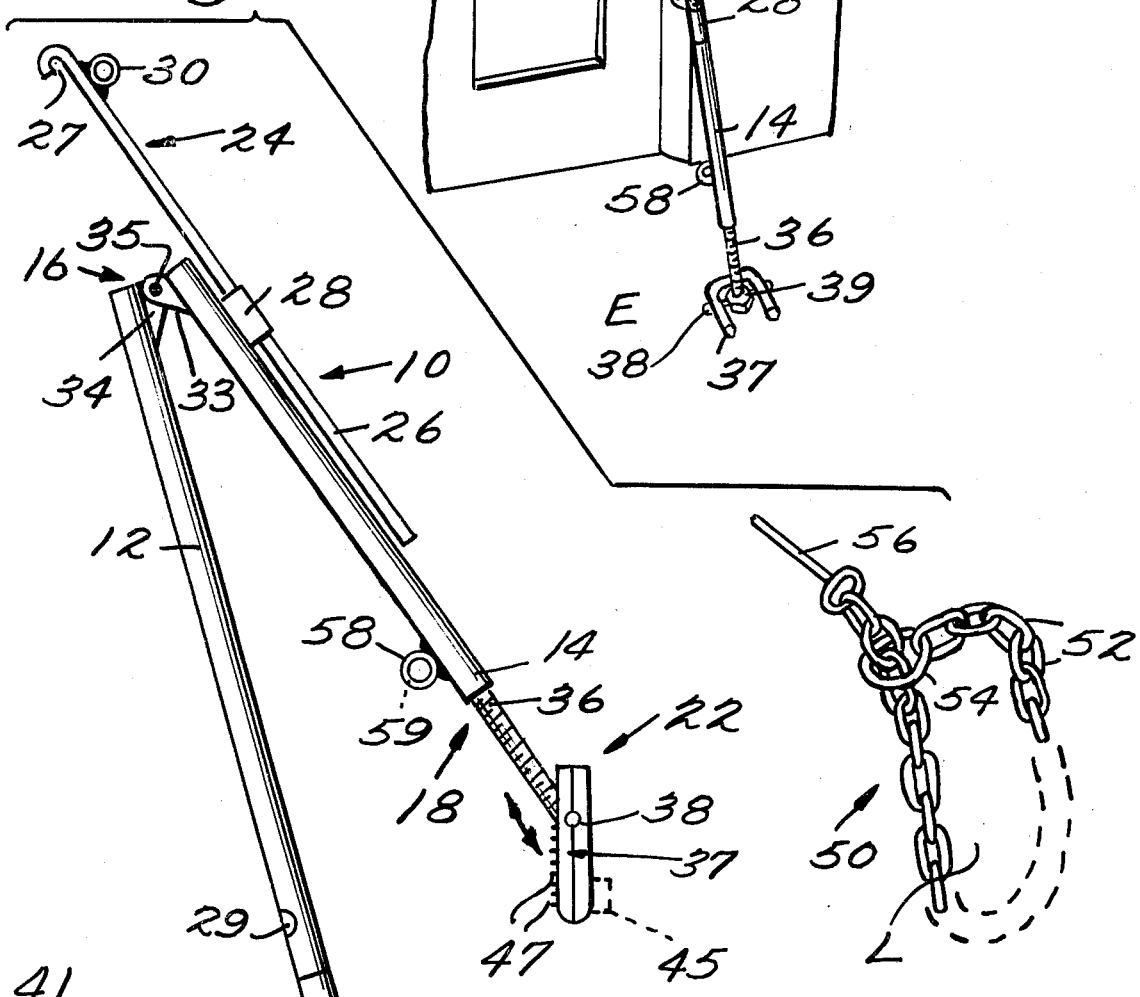
FIG. 2 is a perspective view of exemplary apparatus according to the present invention in a configuration for ready transport or storage thereof.

The pivotal means 16 may comprise—illustrated in FIG. 2—a pair of ear members 33 formed on the second rod 14 receiving an ear member 34 formed on the first rod 12 therebetween, with a pivot pin 35 extending through and between the ears 33,34. The adjustment means 18 preferably comprises a screw threaded rod 36 attached to the engaging means 22, and received by a threaded interior portion of the second rod 14 (not shown), rotation of the rod 36 effecting adjustment of the effective length of the second rod 14 from the ears 33 to the engaging means 22. The means 20 for abutting the movable closure preferably comprises a fork 32 which is adapted to engage a knob K2 (see FIG. 1), the fork having an exterior surface of abrasion and slippage preventing material, such as a coating of rubber or plastic: the engagement of such material with K2 will resist turning movement of K2.

The stationary member engaging means 22 comprises a member 37 operatively mounted by a pivot pin 38 to a collar 39 which receives the screw threaded rod 36. The collar 39 may include a universal joint which allows the positioning of the apparatus 10 off center of the door knob K2 while still performing its door-opening preventing function, or the opening in the collar 39 receiving the shaft 38 may have a small amount of play therein so that the same purpose—a cooperation with the rotational movement between the screw threaded rod 36 and the second rod 14—is provided.

The member 22 has first and second substantially parallel faces 41, 43 (see FIG. 3 in particular) thereof, the faces having different textures each capable of engaging the stationary member without defacement or destruction of the stationary member (e.g. floor F). The pivot pin 38, combined with the U-shaped construction of the member 37 (or alternatively using a U-shaped bracket in place of collar 39) allows pivotal movement of the member 37 from a position wherein the first face 41 engages the stationary member F to a position wherein the second face 43 engages the stationary member F. The first face 41 is adapted to engage smooth surfaces (e.g. tile or wood floors F), and thus includes a rubberized material, such as a coating of rubber or plastic, or—as illustrated in dotted line at 45 in FIG. 2—one or more rubber feet or suction cups 45. The second face 43 preferably includes a plurality of projections 47 which are adapted to securely engage a carpet without defacing or destroying the carpet.

Figure 3:
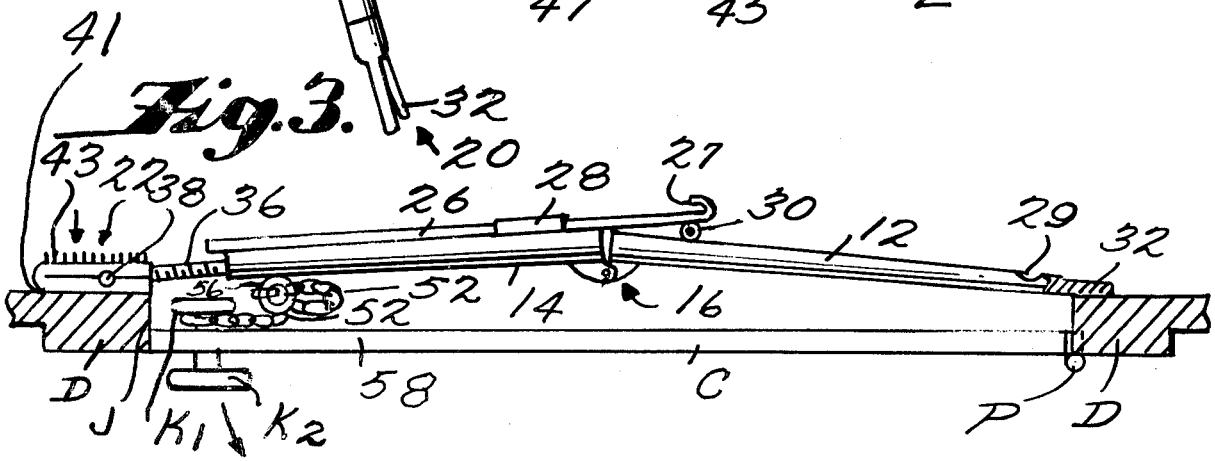
FIG. 3 is a top plan view of the apparatus of FIG. 2 in use for preventing the opening of a pivoted closure on a jamb side of the closure.

FIG. 3 illustrates the use of the elongated member 10 according to the present invention to prevent movement of a closure (door C) from the jamb side of the door. The door C is pivoted at hinges P, and abuts the jamb J when in closed position. Means 50 are provided (see FIG. 2 in particular) associated with member 10 for operatively holding the member 10 between the closure C and a stationary member (e.g. door frames D) on the jamb side of the closure C. The operative holding means 50 includes a chain 52 having an enlarged link 54 formed on one end thereof, and a tubular member 58 formed on the member 10, the member 58 having a slot formed therein extending in a plane perpendicular to the passageway extending through the tubular member 58. The slot is indicated at dotted line at 59 in FIG. 2, and is wide enough to receive a link 52' (see FIG. 3) of the chain 52 therein. A loop L is formed by the chain 52 and the enlarged link 54, and loop L is disposed around the door knob K1, a link 52' is inserted into slot 59, and pin 56 is passed through the passageway in member 58 and through the opening in link 52' interiorly of the member 58. Then rod 26 is rotated so that grasping member 30 (which may be rubber coated) is in the position illustrated in FIG. 3, and the rod 26 is slid with respect to sleeve 28 until the member 30 positively abuts rod 12, tightening the chain 52 and holding the entire structure in locking position as illustrated in FIG. 3.

The structure according to the present invention having been described, exemplary manners of operation thereof will now be set forth:

In order to prevent the opening of a pivoted door C from the opening side thereof, the elongated member 10 is moved into operative position by pivoting the first rod 12 with respect to the second rod 14 so that they are in end-to-end relationship, the member 30 is grasped and rod 26 is moved upwardly with respect to the second rod 14 until the hook 27 is inserted in the opening 29, and then a downward force is exerted on the member 30 locking hook 27 into opening 29. The fork 32 is placed in operative relationship with the door knob K2—as illustrated in FIG. 1—care being taken to ensure that the member 10 is of correct length by rotation of the screw threaded rod 36 with respect to the second rod 14 so that it adjusts the effective length of the member 10. The correct face 41, 43 of the engaging means 22 is selected depending upon whether the floor F is smooth or carpeted. For a smooth floor, the member 37 is pivoted so that face 41 engages the floor F, and then the member 10 is pushed into place with the fork 32 engaging door knob K2 and the face 41 engaging floor F, as illustrated in FIG. 1. In order to disassemble the member 10, the reverse steps are followed.

When it is desired to use the member 10 for preventing opening of the pivoted closure C from the jamb (J) side thereof, the member 10 is utilized as shown in FIG. 3. The loop L is formed by chain 52 and enlarged link 54 is placed over the door knob K1, and the member 10—with hook 27 disconnected from opening 29—is placed across the door frame, fork 32 engaging one side and face 41 of means 22 engaging the other side of door frame D. The chain 52 is tightened to the extent possible, and one link (52') thereof is inserted into slot 59 of member 58, and elongated pin 56 is passed through the top of the passageway through member 58 and through the opening in link 52', thus maintaining link 52' stationary with respect to member 58 (and thus rod 14). Then rod 26 is rotated so that the member 30 faces toward rod 12, and rod 26 is slid through sleeve 28 until the member 30 positively abuts a portion of rod 12, this action tightening up the chain 52 so that the member 10 is positively held in the locking position illustrated in FIG. 3.

It will thus be seen that according to the present invention a simple, versatile, and effective apparatus for preventing the opening of a movable closure from either side thereof has been provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. Apparatus for preventing the opening of a movable closure comprising first and second elongated rods; means for pivotedly mounting said first and second rods for movement from a first position wherein the rods abut in substantially end-to-end relationship to a second position wherein the rods extend substantially parallel to each other; means for effecting adjustment of the effective length of at least one of said rods; means associated with said first rod for firmly abutting the movable closure; means associated with said second rod for engaging a stationary member adjacent the closure to prevent relative movement between the closure and the stationary member; and means for selectively locking said first and second rods in the first position thereof; said means for selectively locking said first and second rods in the first position thereof comprising a third elongated rod having a latching portion formed as a hook on one end thereof; means formed on one of said first and second rods for allowing guided linear movement of said third rod parallel to said one of said first and second rods; and latching means formed on the other of said first and second rods for cooperating with said latching portion of said third rod to maintain said third rod latched in a position wherein it extends across said first and second rods in operative engagement with each; said latching means comprising means defining an aperture in said other of said first and second rods for receipt of said hook therein.

2. Apparatus as recited in claim 1 wherein said means for allowing guided linear movement of said third rod comprises a sleeve, which allows relative rotational movement of said third rod within it.

3. Apparatus as recited in claim 1 further comprising a grasping member formed on said third rod adjacent said hook for facilitating relative movement of said third rod with respect to said first and second rods, and wherein said one rod comprises said second rod, and wherein said other rod comprises said first rod.

4. Apparatus as recited in claim 1 wherein said means associated with said first rod for abutting said closure comprise a fork having an exterior surface of abrasion and slippage preventing material.

5. Apparatus for preventing the opening of a movable closure comprising an elongated substantially rigid member having a first end thereof formed for abutting the closure; and means formed on a second end thereof, opposite said first end, for engaging a stationary member adjacent the closure to prevent relative movement between the closure and the stationary member; wherein the improvement comprises:

said means for engaging the stationary member comprising a U-shaped engaging member having two legs, and having first and second substantially parallel faces, the faces having different textures each capable of engaging the stationary member without defacement or destruction of the stationary member; and for mounting said engaging member with respect to said elongated member so that the legs of said U-shaped engaging member are on opposite sides of said elongated member and so that said engaging member may pivot from a position wherein said first face engages the stationary member to a position wherein said second face engages the stationary member.

6. Apparatus recited in claim 5 wherein the first face has a texture for engaging a smooth-surfaced stationary member in non-slip relationship, and wherein the second face has a texture for engaging a carpet in non-slip relationship.

7. Apparatus as recited in claim 6 wherein said first face includes a rubberized material, and wherein said second face includes a plurality of projections.

8. Apparatus for preventing the opening of a pivoted closure, for opening in one direction and abutting a jamb member for stopping movement in the other direction, said apparatus comprising:

an elongated substantially rigid member; and means for operatively holding said elongated member between the pivoted closure and a stationary member adjacent either the jamb side or the opening side of the pivoted closure so that the pivoted closure may not move with respect to the stationary member whether said elongated member is disposed on the jamb side or the opening side of the pivoted closure.

9. Apparatus as recited in claim 8 wherein said operatively holding means comprises a chain having an enlarged link formed at one end thereof and an elongated pin at the other end thereof, and a tubular member formed on said elongated substantially rigid member, the tubular member having a slit formed therein for receipt of a link from said chain, and the passageway through said tubular member being large enough to allow the passage of said elongated pin therethrough.

10. Apparatus as recited in claim 9 wherein said elongated substantially rigid member comprises first and second rods pivotedly mounted together, and wherein said operative holding means includes a third rod, a sleeve mounted on said second rod for allowing linear guided and rotational movement of said third rod with respect to said first and second rods, and a member formed on said third rod adjacent one end thereof for engaging said first rod to tighten the chain and hold the elongated member in locking position on the jamb side of the pivoted closure.

11. Apparatus as recited in claim 10 wherein said third rod has a hook latching portion formed on the end thereof adjacent said member formed on said third rod, said hook being disposed substantially 180° around said rod as said member, and said member being a grasping member; and wherein means defining an aperture in said first rod are provided for receipt of said hook therein for locking said elongated member in a position wherein said first and second rods are in end-to-end position.

12. Apparatus as recited in claim 1 wherein said means for effecting adjustment of the effective length of at least one of said rods comprises a screw threaded rod extending between said second rod and said means associated with said second rod for engaging a stationary member adjacent the closure.

13. Apparatus as recited in claim 11 wherein said grasping member is rubber coated.

* * * * *